US007984524B1

(12) United States Patent
Haessly

(10) Patent No.: US 7,984,524 B1
(45) Date of Patent: Jul. 26, 2011

(54) SWIVEL LIFT GRAB BAR

(76) Inventor: Michael A. Haessly, Brookfield, WI (US)

( * ) Notice: Subject to any disclaimer, the term of this patent is extended or adjusted under 35 U.S.C. 154(b) by 925 days.

(21) Appl. No.: 11/840,483

(22) Filed: Aug. 17, 2007

(51) Int. Cl.
*A61G 7/14* (2006.01)
*A61G 7/053* (2006.01)

(52) U.S. Cl. ..... 5/662; 5/83.1; 5/87.1

(58) Field of Classification Search ..... 5/662, 81.1 R, 5/83.1, 85.1, 87.1
See application file for complete search history.

(56) References Cited

U.S. PATENT DOCUMENTS 4,554,691 A * 11/1985 Daugherty ..... 5/87.1
4,571,758 A * 2/1986 Samuelsson ..... 5/83.1
4,703,523 A * 11/1987 James ..... 5/83.1
4,976,455 A 12/1990 Brammer, Sr. ..... 280/762
5,022,106 A * 6/1991 Richards ..... 5/86.1
5,090,072 A * 2/1992 Gray ..... 5/87.1
5,586,352 A 12/1996 O'Brien et al. ..... 5/662
6,035,465 A * 3/2000 Rogozinski ..... 5/83.1
7,178,181 B1 * 2/2007 Fulmer ..... 5/83.1

OTHER PUBLICATIONS

Print Out of molift.co.uk/quickraiser.html Webpage Disclosing a Molift Quick Raiser.

* cited by examiner

*Primary Examiner* — Robert G Santos
(74) *Attorney, Agent, or Firm* — Donald J. Ersler

(57) ABSTRACT

A swivel lift grab bar includes an angled support member, a bottom leg and a top leg. Top and bottom pivot brackets are attached to a vertical surface. An end of the bottom leg is pivotally engaged with the bottom pivot bracket and an end of the top leg is pivotally engaged with the top pivot bracket. A double knee support is preferably attached to the bottom leg. The vertical surface may be replaced with a moveable support pole, a rigid support pole, a support post or a wall mounted support post. A second embodiment of the swivel lift grab bar includes an angled lift member and a bottom leg. The angled lift member includes a lift channel, a lift bar, a lead screw and a drive motor. A set of controls are located on the lift bar to operate at least one motor.

12 Claims, 19 Drawing Sheets

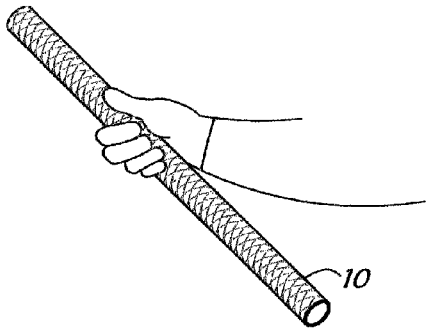
FIG. 2
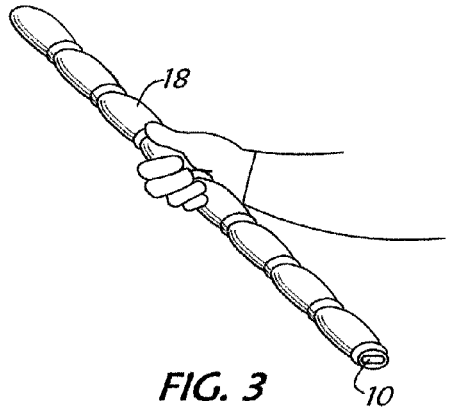
FIG. 3
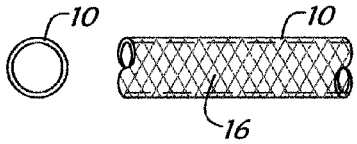
FIG. 2a FIG. 2b
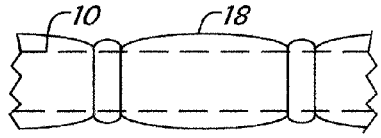
FIG. 3a
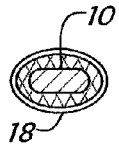
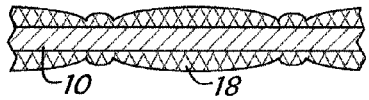
FIG. 3b FIG. 3c

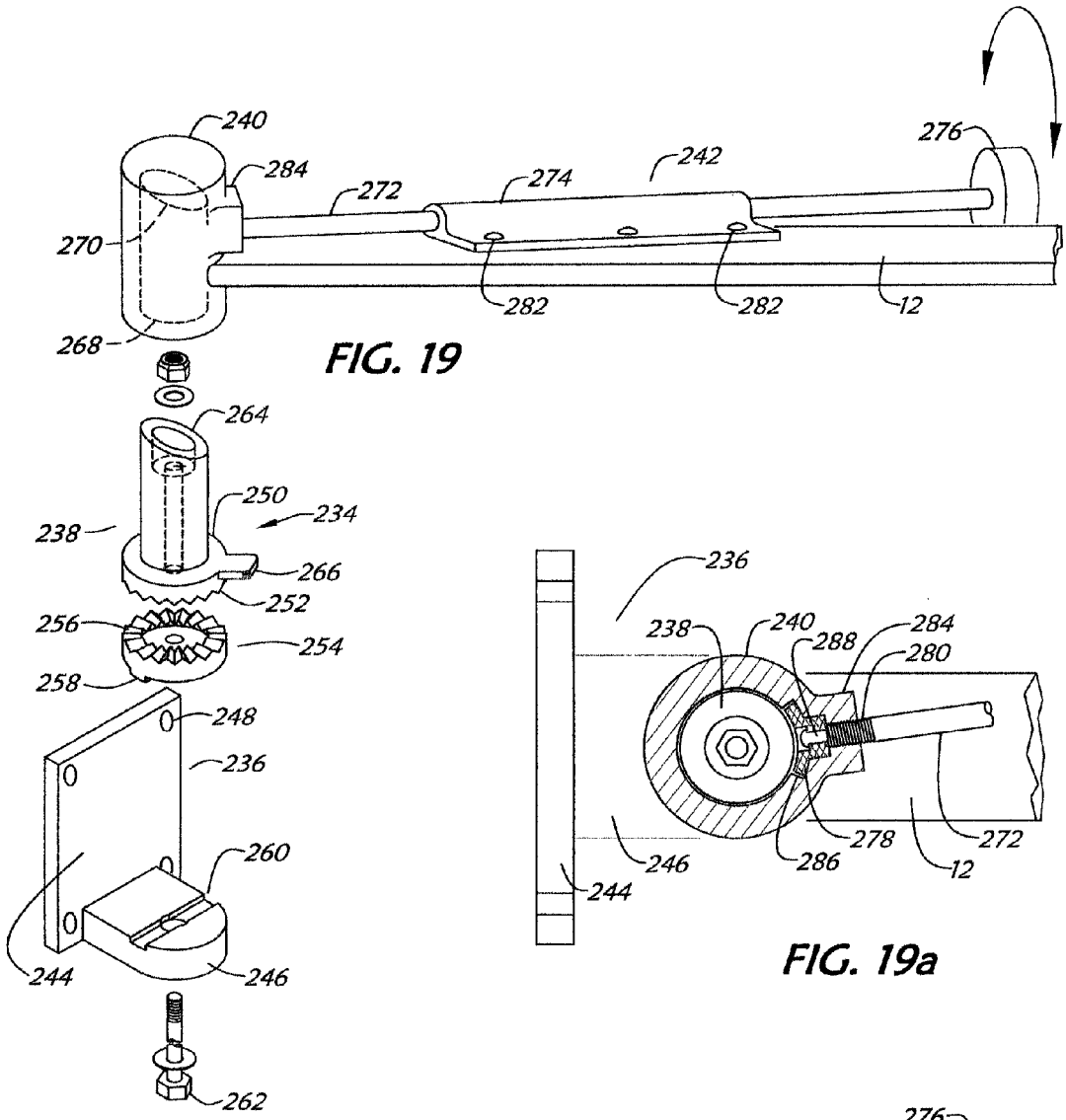
FIG. 19
FIG. 19a
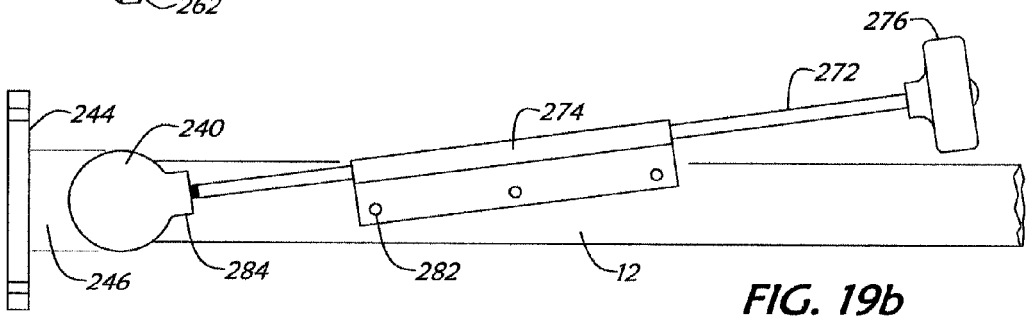
FIG. 19b

SWIVEL LIFT GRAB BAR

BACKGROUND OF THE INVENTION

1. Field of the Invention

The present invention relates generally to grab bars and more specifically to a swivel lift grab bar, which allows a user to lift their body from a first location and transfer it to a second location.

2. Discussion of the Prior Art

U.S. Pat. No. 4,976,455 to Brammer, Sr. et al. discloses a handrail. The Brammer, Sr. et al. patent includes a handrail assembly for use on a marine vessel, travel trailer, motor home or other recreational vehicle. The handrail assembly is pivotally mounted to the side thereof to effect easy adjustment of the handrail between an extended, operative position facilitating access to the vehicle or vessel and a collapsed, storage position avoiding interference during the travel thereof.

U.S. Pat. No. 5,586,352 to O'Brien et al. discloses a support pole with a pivoting and locking handrail for elderly and disabled persons. The O'Brien et al. patent includes a support pole for elderly and disabled persons having a pivoting and locking horizontal handrail. It further includes a telescopic pole adapted to be vertically fixed between the floor and ceiling of a room and a horizontal handrail pivotally mounted thereon.

Accordingly, there is a clearly felt need in the art for a swivel lift grab bar, which includes a pivoting grab bar that allows a user to lift-up their body from a first location and transfer it to a second location along an arc of the pivoting grab bar.

SUMMARY OF THE INVENTION

The present invention provides a swivel lift grab bar, which allows a user to lift-up their body and to transfer it from one location to another. The swivel lift grab bar includes an angled support member, a bottom leg and a top leg. The bottom leg extends from a bottom of the angled support member and the top leg extends from a top of the angled support member. A back of a bottom pivot bracket is attached to a vertical surface, such as a wall and a back of a top pivot bracket is attached to the vertical surface. An end of the bottom leg is pivotally engaged with the bottom pivot bracket and an end of the top leg is pivotally engaged with the top pivot bracket. A double knee support is preferably attached to a bottom of the bottom leg at substantially the junction of the angled support member. A grab cover may be used to enclose the angled support member to improve the grip thereof.

The vertical surface may be replaced with a moveable support pole, a rigid support pole, a support post or a wall mounted support post. The moveable support pole includes a moveable base, a telescoping support pole and a ceiling pad. One end of the telescoping support pole is mounted to the moveable base and the ceiling pad is attached to the other end of the telescoping support pole. The bottom leg is terminated with a bottom pivot sleeve and the top leg is terminated with a top pivot sleeve. The bottom and top pivot sleeves are retained on the telescoping support pole.

The rigid support pole includes a support pole, a bottom support flange and a top support flange. One end of the support pole is attached to the bottom support flange and the other end is attached to the top support flange. The bottom support flange is secured to a floor with fasteners or the like and the top support flange is secured to a ceiling with fasteners or the like. The bottom and top pivot sleeves are retained on the support pole.

The support post includes a self-supporting post, a bottom flange and a plurality of gussets. The bottom flange is attached to a bottom of the self-supporting post. The plurality of gussets are attached to the bottom flange and the post member. The bottom flange is attached to a floor with a plurality of fasteners. Top and bottom pivot brackets are attached to the self-supporting post to pivotally retain the swivel lift grab bar. The wall mounted support post includes a post member and a plurality of attachment brackets. The plurality of attachment brackets are attached to a side of the post member, such that the post member may be secured to a wall and a floor. Top and bottom pivot brackets are attached to the post member to pivotally retain the swivel lift grab bar.

A second embodiment of the swivel lift grab bar includes an angled lift member and a bottom leg. The angled lift member includes a lift channel, a lift bar, a lead screw and a drive motor. The lead screw is retained in the lift channel and the lift bar is threadably engaged with the lead screw. The lead screw is rotated by the drive motor. A set of controls are located on the lift bar to operate the drive motor. A pivoting drive motor may be used to rotate a bottom of the moveable support pole. A double knee support is preferably attached to a bottom of the bottom leg at substantially the junction of the angled support pole. A double foot rest may be pivotally mounted to the double knee support. The double knee support and the double foot rest may be replaced with a double leg cup. The double leg cup supports partially amputated leg thighs.

Accordingly, it is an object of the present invention to provide a swivel lift grab bar, which includes a pivoting grab bar that allows a user to lift-up their body from a first location and transfer it to a second location along an arc of the pivoting grab bar.

These and additional objects, advantages, features and benefits of the present invention will become apparent from the following specification.

BRIEF DESCRIPTION OF THE DRAWINGS

FIG. 2 is a perspective view of a tubular angled support pole of a swivel lift grab bar in accordance with the present invention.

FIG. 2*a* is an end view of a tubular angled support pole of a swivel lift grab bar in accordance with the present invention.

FIG. 2*b* is a side view of a tubular angled support pole of a swivel lift grab bar in accordance with the present invention.

FIG. 3 is a perspective view of an angled support pole with a grab cover of a swivel lift grab bar in accordance with the present invention.

FIG. 3*a* is a side view of an angled support pole with a grab cover of a swivel lift grab bar in accordance with the present invention.

FIG. 3*b* is a cross sectional end view of an angled support pole with a grab cover of a swivel lift grab bar in accordance with the present invention.

FIG. 3*c* is a cross sectional side view of an angled support pole with a grab cover of a swivel lift grab bar in accordance with the present invention.

FIG. 19 is a partially exploded perspective view of a bottom adjustable pivot assembly of a swivel lift grab bar in accordance with the present invention.

FIG. 19*a* is a cross sectional top view of a bottom sleeve of an adjustable pivot assembly of a swivel lift grab bar in accordance with the present invention.

FIG. 19*b* is a top view of a rotation control assembly of a of a swivel lift grab bar in accordance with the present invention.

DETAILED DESCRIPTION OF THE PREFERRED EMBODIMENTS

Figure 1:
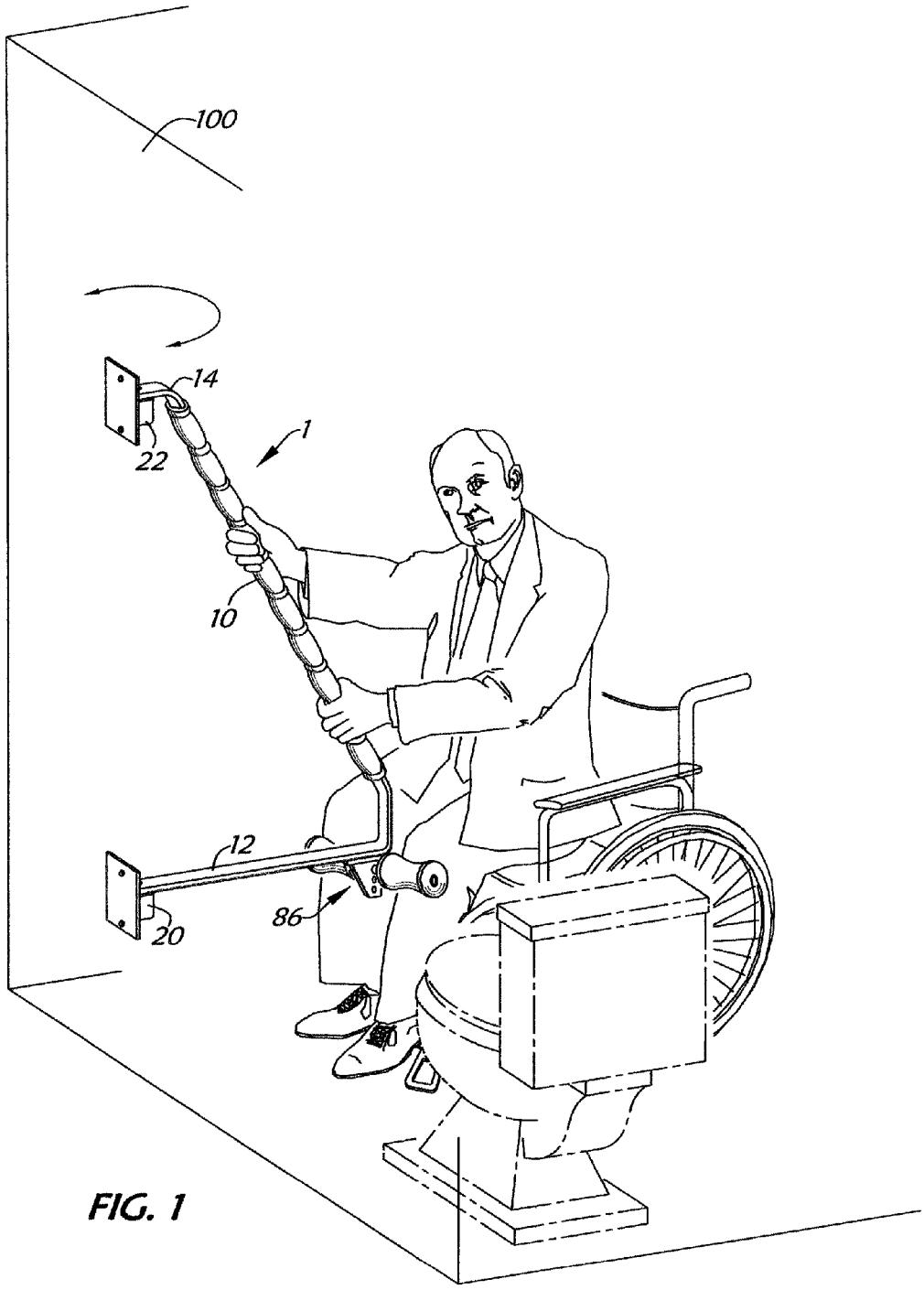
FIG. 1 is a perspective view of a swivel lift grab bar pivotally retained on a wall in accordance with the present invention.

With reference now to the drawings, and particularly to FIG. 1, there is shown a perspective view of a swivel lift grab bar 1. The swivel lift grab bar 1 includes an angled support member 10, a bottom leg 12 and a top leg 14. The bottom leg 12 extends from a bottom of the angled support member 10 and the top leg 14 extends from a top of the angled support member 10. With reference to FIGS. 2-2*b*, an angled support member 10' is tubular with a knurled finish 16 for gripping by a user. With reference to FIGS. 3-3*c*, a grab cover 18 is slipped over the angled support member 10. A back of a bottom pivot bracket 20 is attached to a vertical surface 100, such as a wall and a back of a top pivot bracket 22 is attached to the vertical surface 100.

Figure 4:
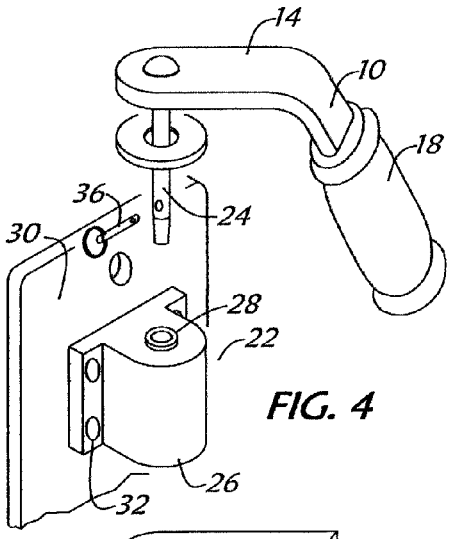
FIG. 4 is a partially exploded perspective view of a top pivot bracket and an end of the angled support pole retained with a lock pin of a swivel lift grab bar in accordance with the present invention.
Figure 4A:
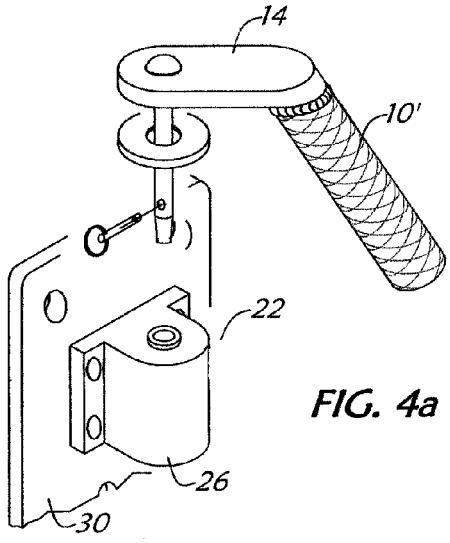
FIG. 4*a* is a partially exploded perspective view of a top pivot bracket and an end of the tubular angled support pole retained with a lock pin of a swivel lift grab bar in accordance with the present invention.
Figure 4B:
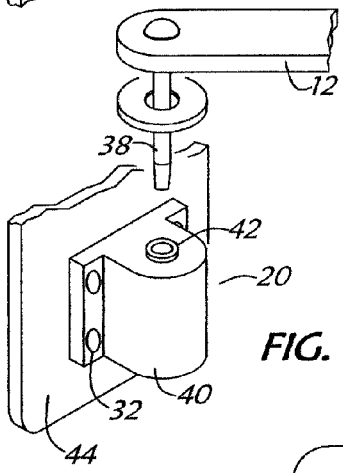
FIG. 4*b* is a partially exploded perspective view of a bottom pivot bracket and an end of the angled support pole of a swivel lift grab bar in accordance with the present invention.
Figure 4C:
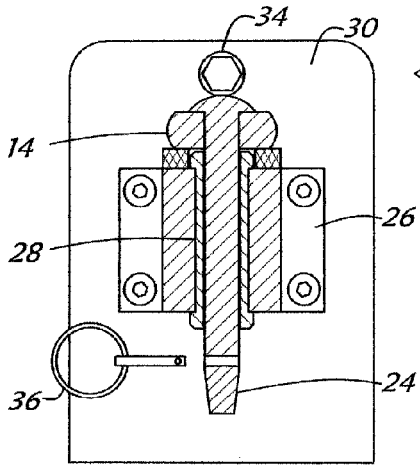
FIG. 4*c* is a front cross sectional of a pivot bracket and an end of the tubular angled support pole retained with a lock pin of a swivel lift grab bar in accordance with the present invention.
Figure 4D:
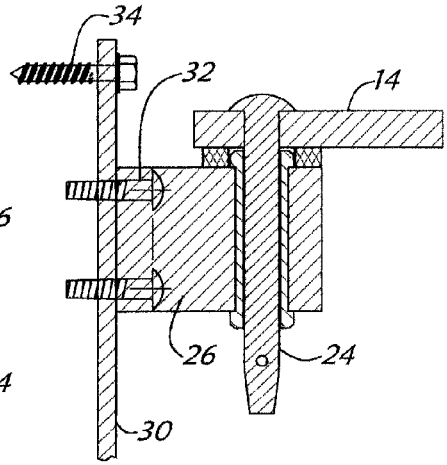
FIG. 4*d* is a side cross sectional of a pivot bracket and an end of the tubular angled support pole retained with a lock pin of a swivel lift grab bar in accordance with the present invention.

With reference to FIGS. 4-4*d*, a top pin 24 extends from the top leg 14. The top pivot bracket 22 includes a top base member 26, a top pin bushing 28 and a top flange plate 30. The top pin bushing 28 is retained in the top base member 26. The top base member 26 is attached to the top flange plate 30 with a plurality of fasteners 32. At least one fastener 34 is inserted through the top flange plate 30 to attach the top pivot bracket 22 to the vertical surface 100. The top pin 24 is inserted through the top pin bushing 28 and preferably retained with a lock pin 36. A bottom pin 38 extends from an end of the bottom leg 12. The bottom pivot bracket 20 includes a bottom base member 40, a bottom pin bushing 42 and a top flange plate 44. The bottom pin bushing 42 is retained in the bottom base member 40. The bottom base member 40 is attached to the bottom flange plate 44 with a plurality of fasteners 32. At least one fastener (not shown) is inserted through the bottom flange plate 44 to attach the top pivot bracket 22 to the vertical surface 100.

Figure 5:
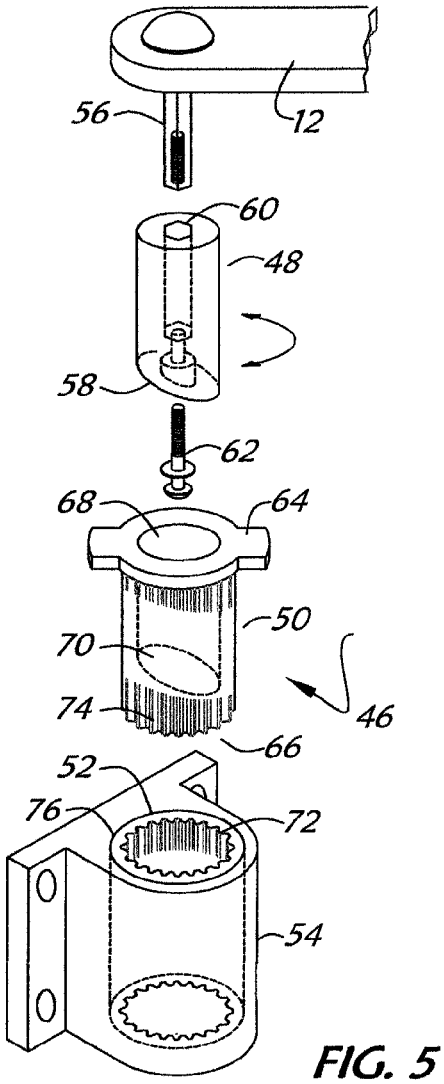
FIG. 5 is an exploded perspective view of a center of gravity pivot bracket and an end of an angled support pole of a swivel lift grab bar in accordance with the present invention.
Figure 5A:
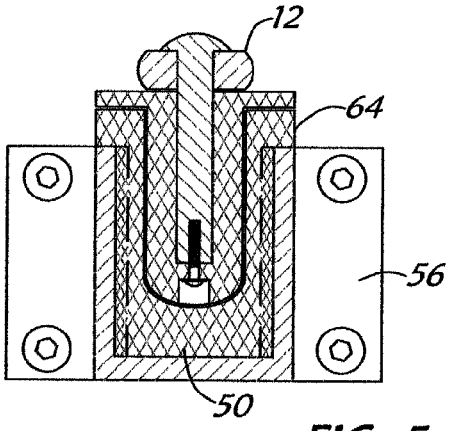
FIG. 5*a* is a front cross sectional view of a center of gravity pivot bracket and an end of a angled support pole of a swivel lift grab bar in accordance with the present invention.
Figure 5B:
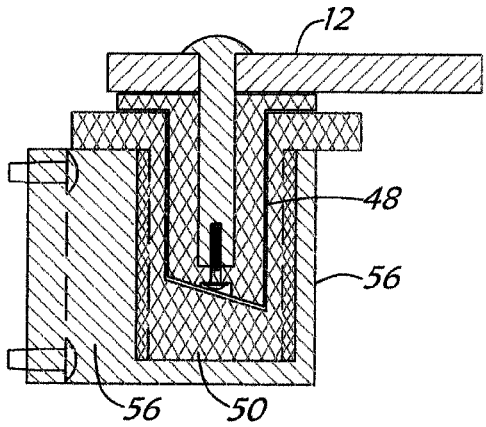
FIG. 5*b* is a side cross sectional view of a center of gravity pivot bracket and an end of a angled support pole of a swivel lift grab bar in accordance with the present invention.

With reference to FIGS. 5-5*a*, the bottom pivot bracket 20 may be replaced with an adjustable center-of-gravity pivot bracket 46. The adjustable center-of-gravity pivot bracket 46 includes a tapered projection 48, a tapered projection receiver 50, an inner spline ring 52, and a pivot base 54. A retention pin 56 extends from the lower leg 12. The tapered projection 48 includes a tapered surface 58 formed on a bottom thereof. A bore 60 is formed through a length of the tapered projection 48 to receive the retention pin 56. The tapered projection 48 is secured to the lower leg 12 with a fastener 62.

The tapered projection receiver 50 includes a handle flange 64 and an outer spline surface 66. A tapered bottom bore 68 is formed on an inside perimeter of the projection receiver 50. A tapered bottom 70 of the tapered bottom bore 68 is shaped to receive the tapered surface 58. The tapered bottom bore 68 is sized to receive the tapered projection 48. The handle flange 64 is formed on an open end of the tapered projection receiver 50. A plurality of inner teeth 72 of the inner spline ring 52 are sized to receive a plurality of outer teeth 74 of the outer spline surface 66. The pivot base 54 includes a bore 76, which is sized to firmly receive the inner spline ring 52. Angular orientation of the flange handle 64 about the pivot base 56 determines the angular resting location of the swivel lift grab bar 1 relative to a vertical surface.

Figure 6:
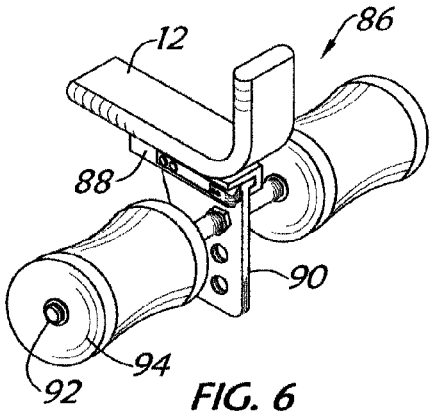
FIG. 6 is a perspective view of a double knee support of a swivel lift grab bar in accordance with the present invention.
Figure 6A:
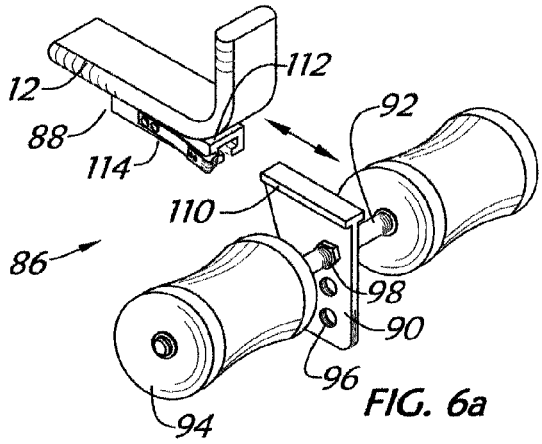
FIG. 6*a* is a partially exploded perspective view of a double knee support of a swivel lift grab bar in accordance with the present invention.

With reference to FIGS. 6-6*a*, a double knee support 86 is attached to a bottom of the bottom leg 12 at substantially the junction of the angled support member 10. The double knee support 86 includes a retention gib 88, a mounting plate 90, a mounting shaft 92 and a pair of knee supports 94. The mounting plate 90 preferably includes a plurality of holes 96 for receiving the mounting shaft 92. The mounting shaft 92 is retained on the mounting plate 90 by threading nuts 98 together on both sides of the mounting plate 90. The pair of knee supports 94 are attached to opposing sides of the mounting shaft 92 with any suitable method.

A flange 110 is formed on a top of the mounting plate 90. An inside perimeter 112 of the flange retainer 88 is sized to slidably receive the flange 110. The mounting plate 90 is retained in the flange retainer 88 with a snap clip 114. The flange retainer 88 is mounted to a bottom of the bottom leg 12 with any suitable method. With reference to FIG. 6*b*, the pair of knee supports 94 are replaced with a double leg cup 116. With reference to FIG. 6*c*, the pair of knee supports 94 are replaced with a pair of leg pads 118.

Figure 6D:
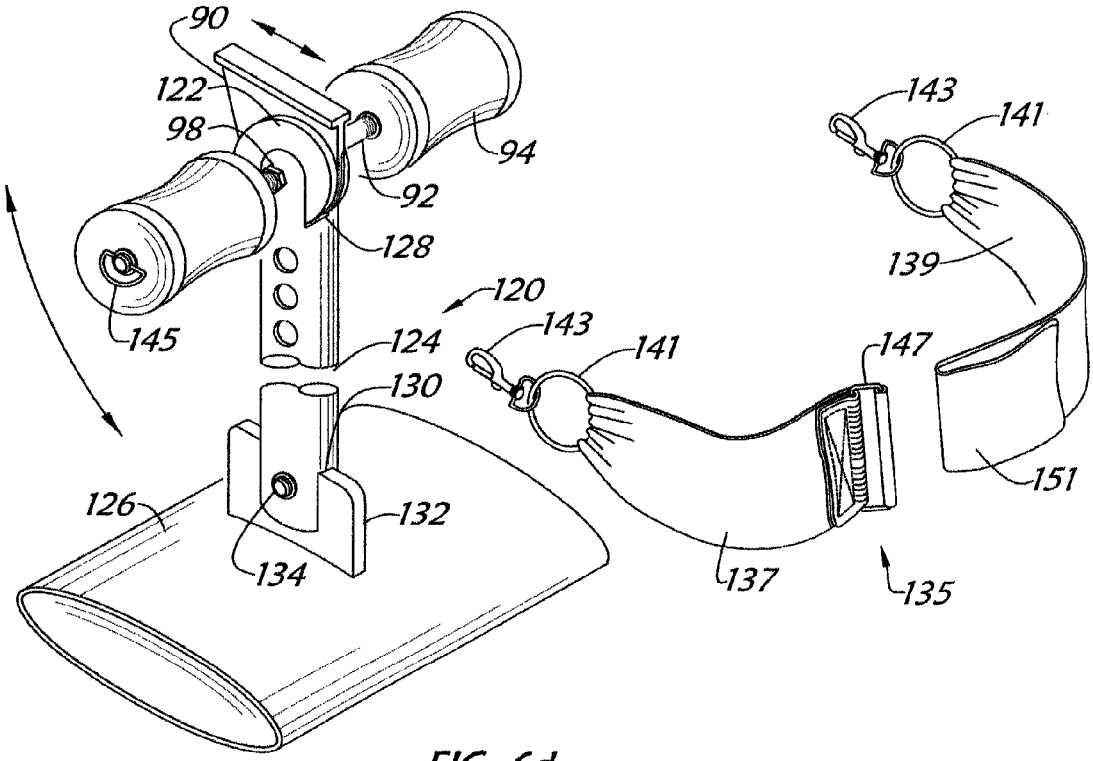
FIG. 6*d* is a partially exploded perspective view of a leg support assembly of a swivel lift grab bar in accordance with the present invention.
Figure 6B:
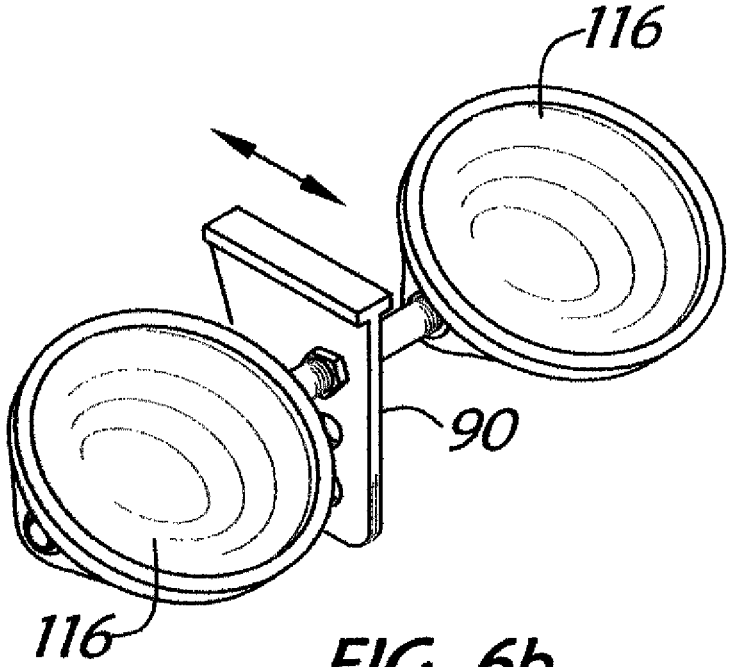
FIG. 6*b* is a perspective view of a double leg cup for support of amputated leg thighs of a swivel lift grab bar in accordance with the present invention.
Figure 6C:
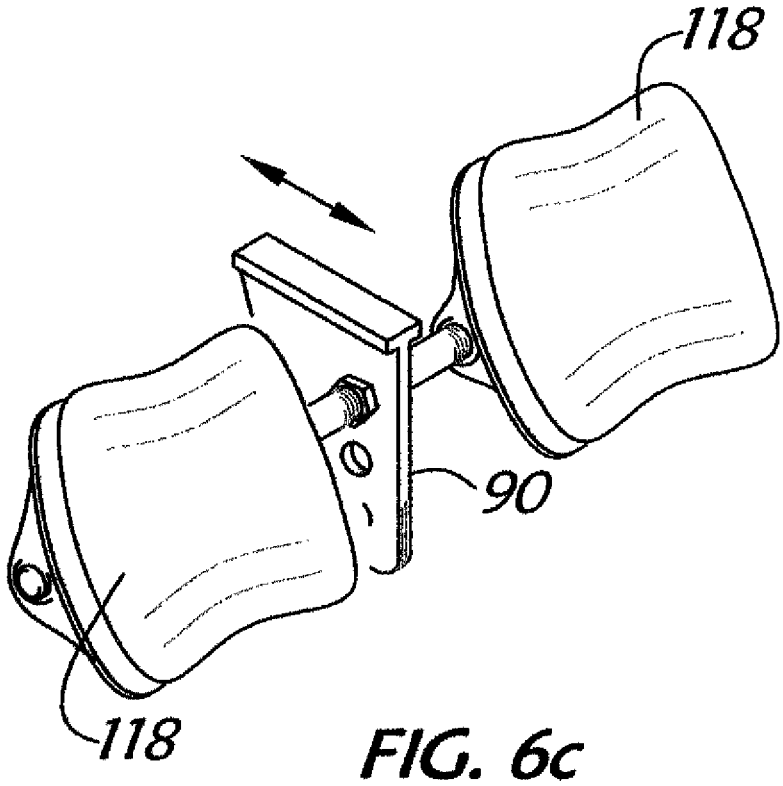
FIG. 6*c* is a perspective view of a double knee support with an alternative knee rest of a swivel lift grab bar in accordance with the present invention.
Figure 7:
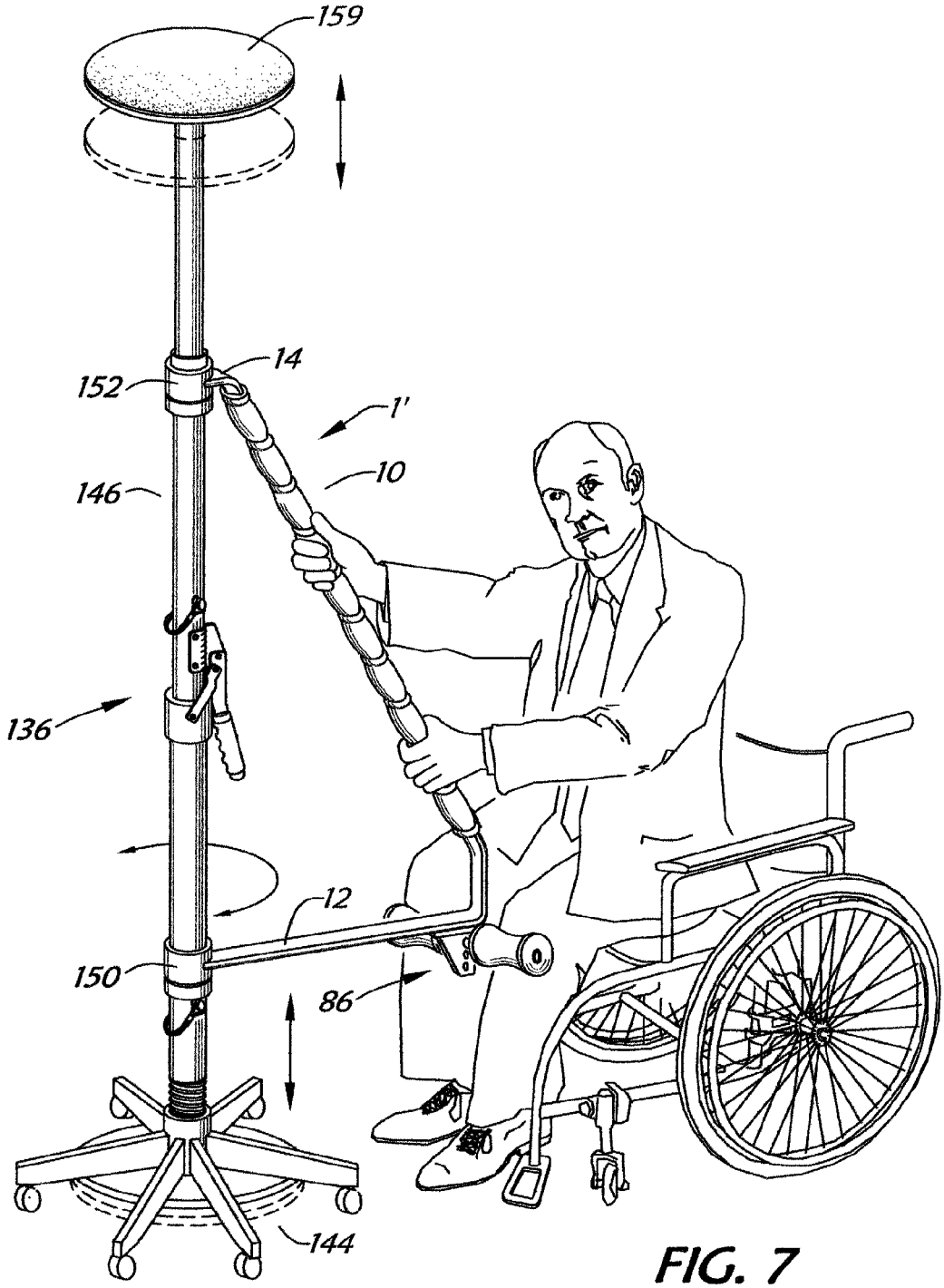
FIG. 7 is a perspective view of a swivel lift grab bar pivotally retained on a moveable support pole in accordance with the present invention.
Figures 7A, 7B:
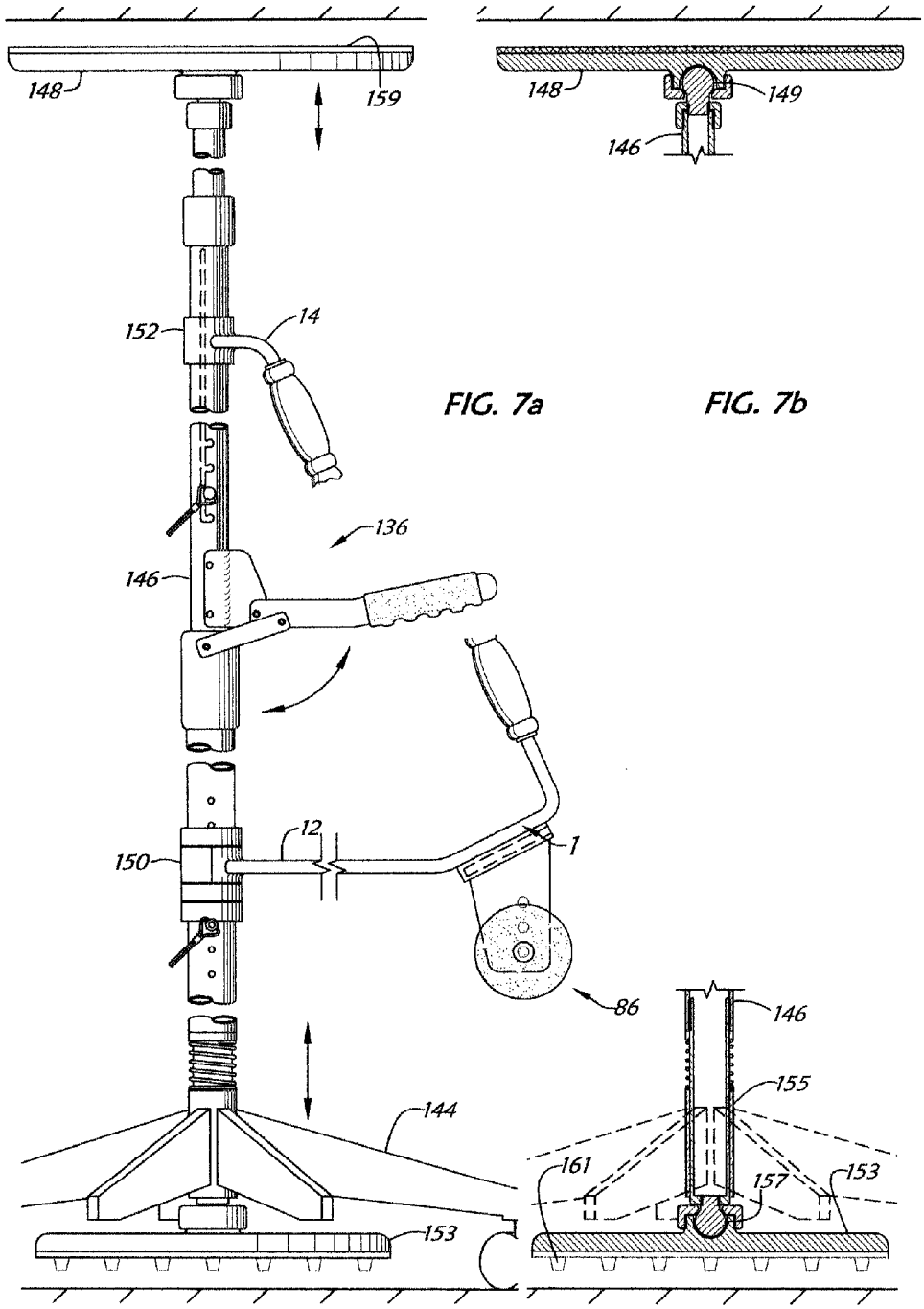
FIG. 7*a* is an enlarged side view of a swivel lift grab bar pivotally retained on a moveable support pole in accordance with the present invention.
FIG. 7*b* is an enlarged cross sectional view of a top and bottom of a moveable support pole in accordance with the present invention.

With reference to FIG. 6*d*, a foot rest 120 is pivotally retained on the mounting shaft 92. The foot rest 120 preferably includes a pair of friction pads 122, a pivot arm 124 and a foot rest 126. A first slot 128 is formed in one end of the pivot arm 124 to receive the pair of friction pads 122 and the mounting plate 90. A second slot 130 is formed in the other end of the pivot arm 124 to receive an attachment flange 132 extending outward from the foot rest 126. The nuts are tightened against both sides of the pivot arm 124, such that the foot rest 126 does not freely swing relative to the mounting plate 90. A fastener 134 is used to retain the attachment flange 132 in the second slot 130.

A leg support 135 may be secured to each end of the mounting shaft 92. The leg support 135 includes a first support member 137, a second support member 139 and a pair of retention rings 141 and a pair of snap clips 143. A D-ring 145 is secured to each end of the mounting shaft 92. One of the snap clips 143 is retained on one of the retention rings 141 and one end of the first support member 137 is also secured to the one retention ring 141. A flap loop 147 is formed on the other end of the first support member 137. The other snap clip 143 is retained on the other retention ring 141 and one end of the second support member 139 is also secured to the other retention ring 141. A securable flap 151 is formed on the other end of the second support member 139. The securable flap 151 is preferably removably securable to the second support member 139 with hook and loop fasteners (not shown) or the like. The securable flap 151 is inserted through the flap loop 147 and secured to the second support member 139. The pair of snap clips 143 are removably secured to the pair D-rings 145.

With reference to FIGS. 7-8, 10 and 11, the vertical surface 100 may be replaced with a moveable support pole 136, a rigid support pole 138, a support post 140 or a wall mounted support post 142. The moveable support pole 136 includes a moveable base 144, a telescoping support pole 146 and a ceiling pad 148. The moveable base 144 is retained on one end of the telescoping support pole 146 and the ceiling pad 148 is preferably pivotally attached on the other end of the telescoping support pole 146 with a top pivot joint 149. A bottom leg 12 of the swivel lift grab bar 1 is terminated with a bottom pivot sleeve 150 and the top leg 14 is terminated with a top pivot sleeve 152. The bottom and top pivot sleeves are sized to be received by an outer perimeter of the telescoping support pole 146. The moveable base 144 includes a rest pad 153 that is pivotally retained by an inner tube 155 slidably disposed in the telescoping support pole 146. The rest pad 153 is pivotally by the inner tube 155 with a bottom pivot joint 157. The rest pad 153 may be lowered to secure a location of the moveable support pole 136. A non-mar surface 159 may be applied to a top of the ceiling pad 148. A griping surface 161 is preferably applied to a bottom of the rest pad 153.

Figure 8:
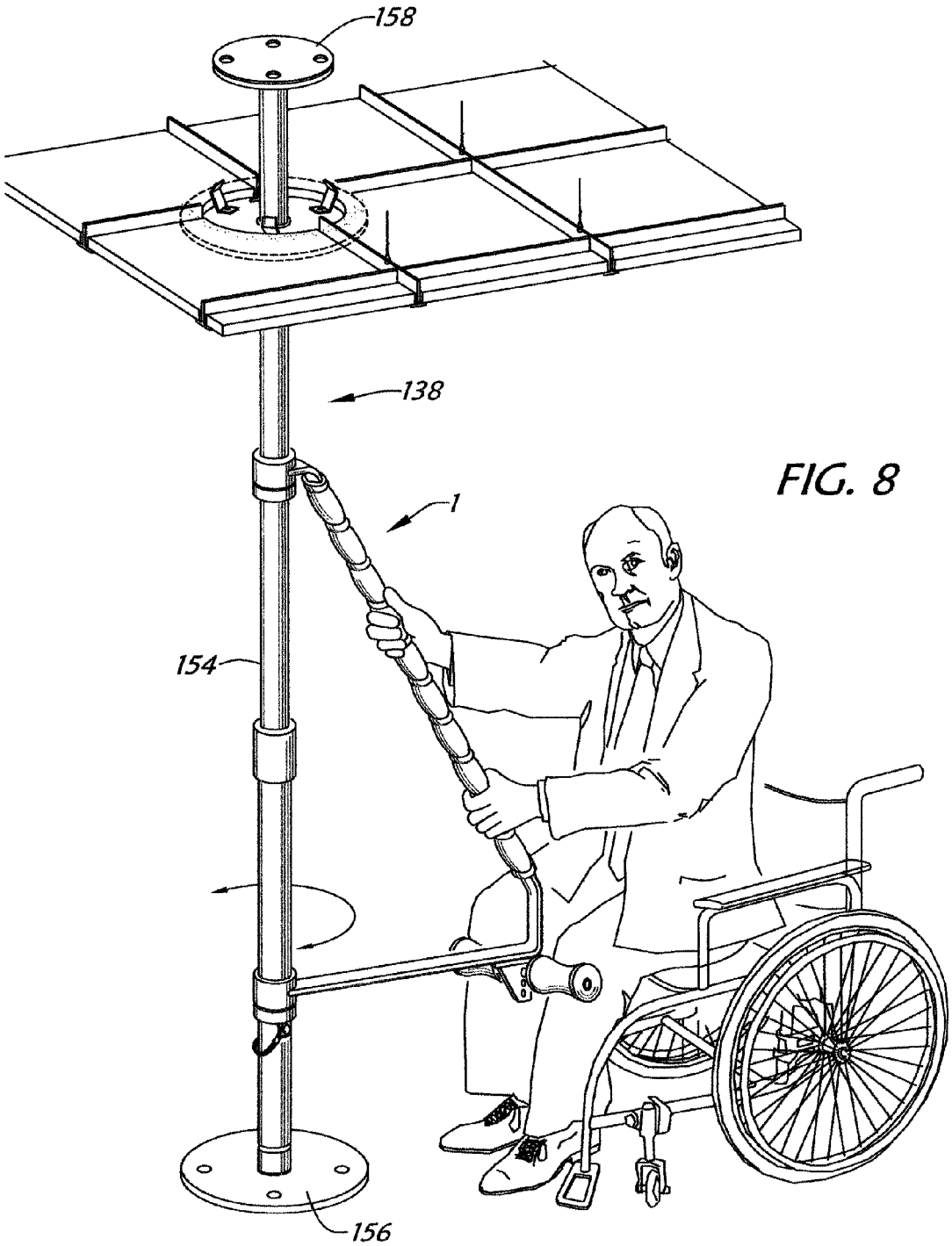
FIG. 8 is a perspective view of a swivel lift grab bar pivotally retained on a rigid support pole in accordance with the present invention.

With reference to FIG. 8, the rigid support pole 138 includes a support pole 154, a bottom support flange 156 and a top support flange 158. One end of the support pole 154 is attached to the bottom support flange 156 and the other end of the support pole 154 is attached to the top support flange 158. The bottom support flange 156 is secured to a floor with fasteners or the like and the top support flange 158 is secured to a ceiling with fasteners or the like.

Figure 10:
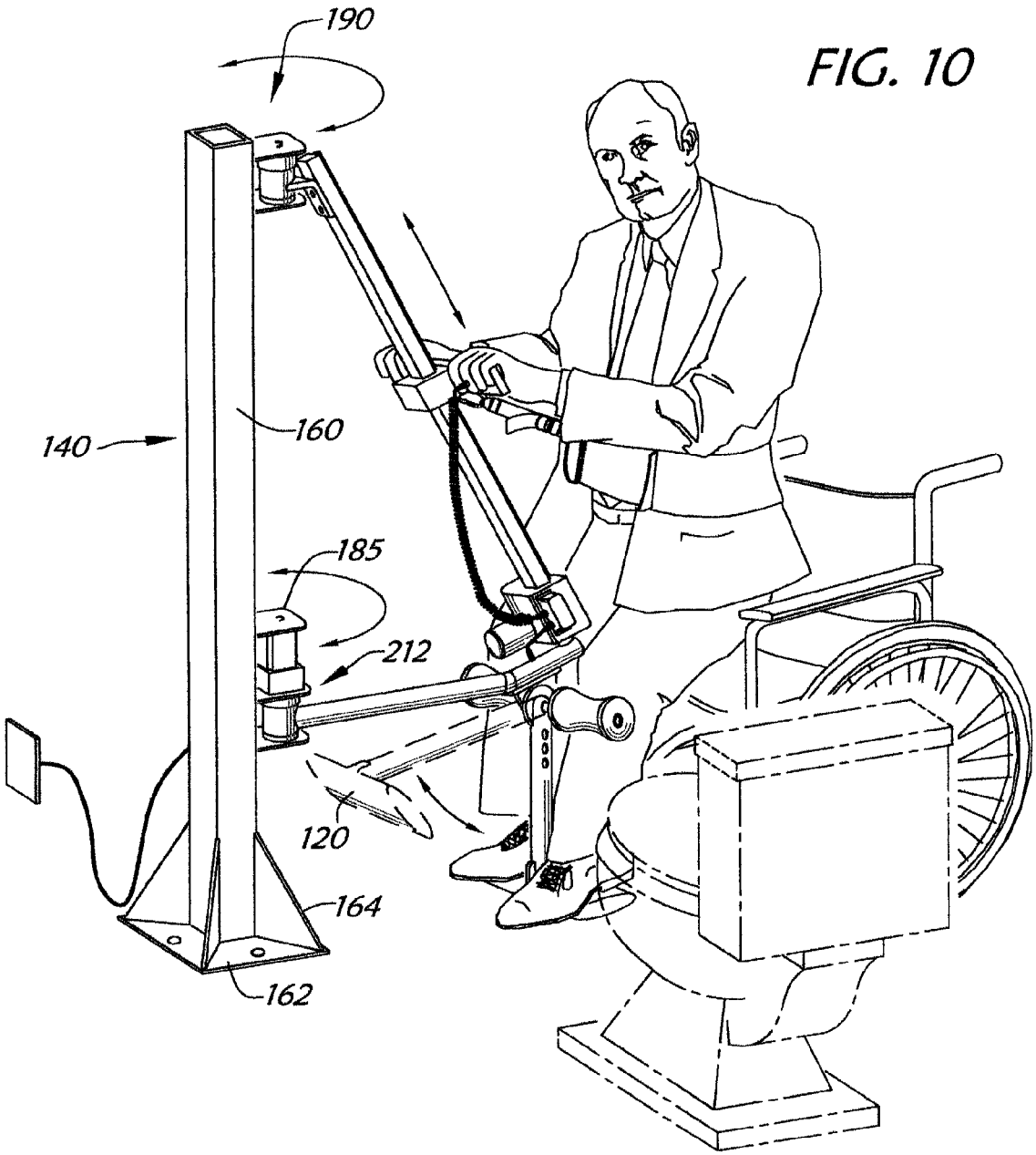
FIG. 10 is a perspective view of a second embodiment of a swivel lift grab bar pivotally retained on a support post in accordance with the present invention.
Figure 11:
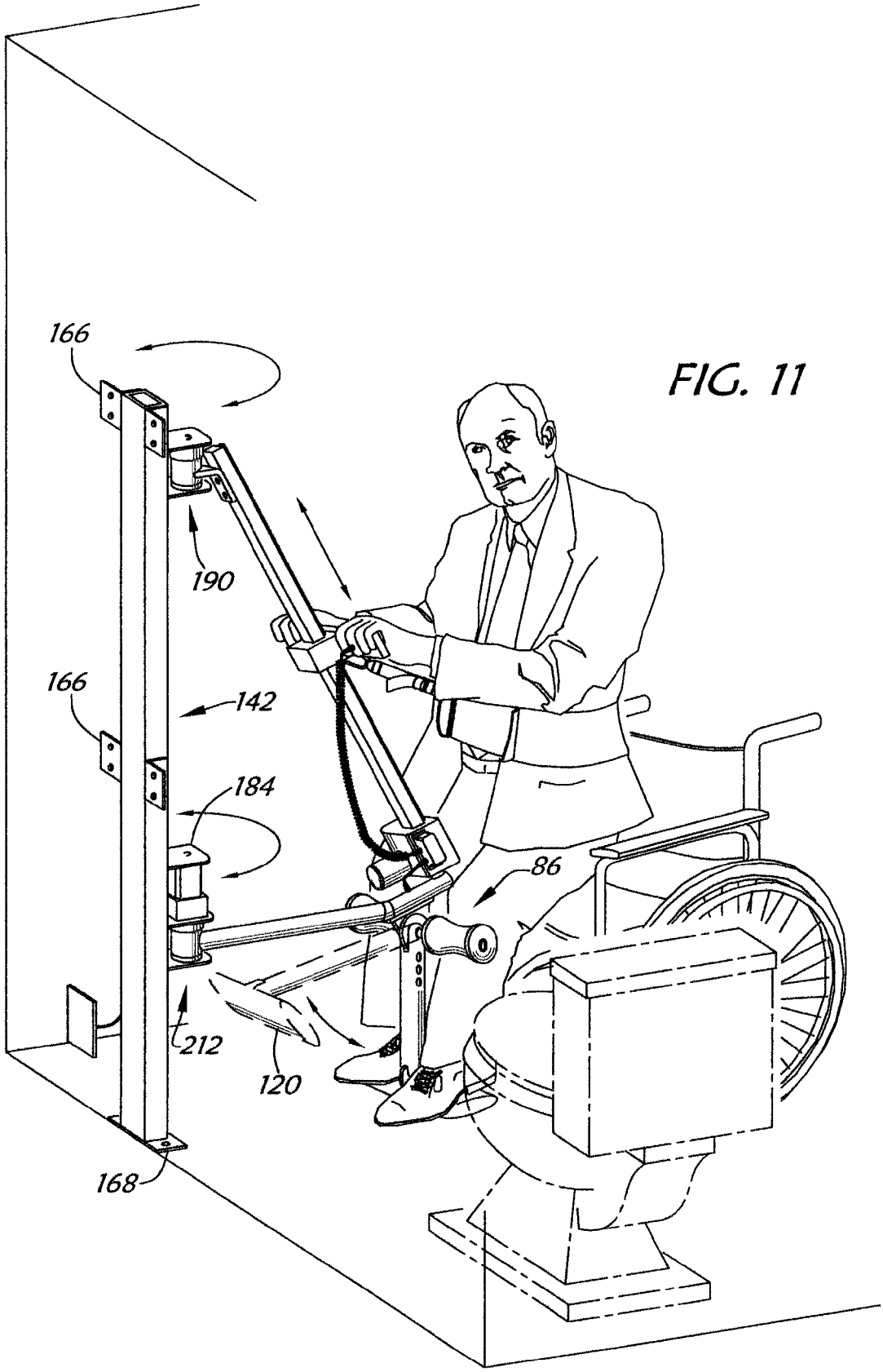
FIG. 11 is a perspective view of a second embodiment of a swivel lift grab bar pivotally retained on a wall mounted support post in accordance with the present invention.

With reference to FIG. 10, the support post 140 includes a self-supporting post 160, a bottom flange 162 and a plurality of gussets 164. The bottom flange 162 is attached to a bottom of the self-supporting post 140 with welding or the like. The plurality of gussets 164 are attached to the bottom flange 162 and the post member 160 with welding or the like. The bottom flange 162 is attached to a floor with a plurality of fasteners. The support post 140 is free standing. With reference to FIG. 11, the wall mounted support post 142 includes a post member 164, a plurality of wall attachment brackets 166 and a pair of floor attachment brackets 168. The plurality of attachment brackets are attached to the post member 164 with welding or the like. The pair of floor attachment brackets 168 are attached to the floor with at least two fasteners and the plurality of wall attachment brackets 166 are attached to the wall with a plurality of fasteners.

Figure 9:
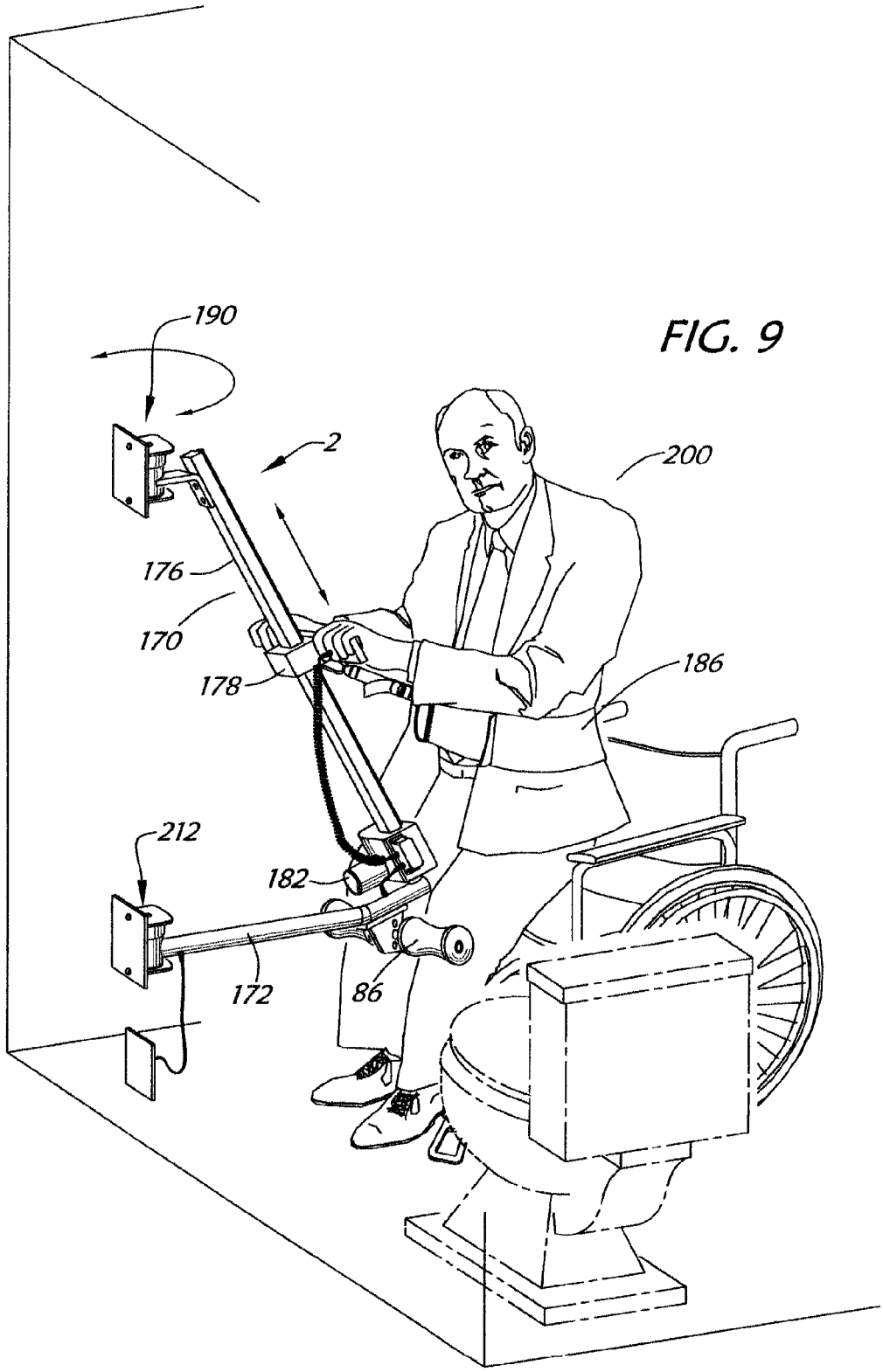
FIG. 9 is a perspective view of a second embodiment of a swivel lift grab bar pivotally retained on a wall in accordance with the present invention.
Figure 16:
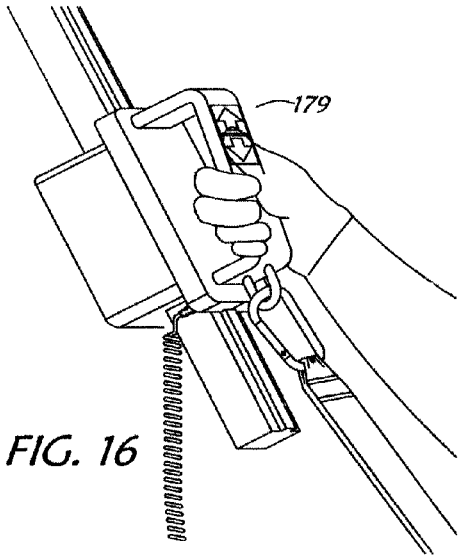
FIG. 16 is a perspective view of a one-handed lift bar of a second embodiment of a swivel lift grab bar in accordance with the present invention.
Figure 18:
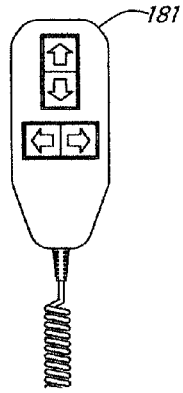
FIG. 18 is a front view of a helper control device of a second embodiment of a swivel lift grab bar in accordance with the present invention.
Figure 18A:
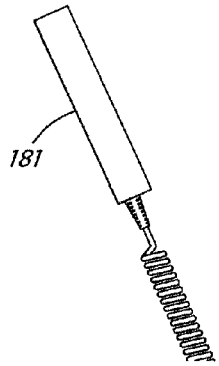
FIG. 18*a* is a side view of a helper control device of a second embodiment of a swivel lift grab bar in accordance with the present invention.
Figure 17:
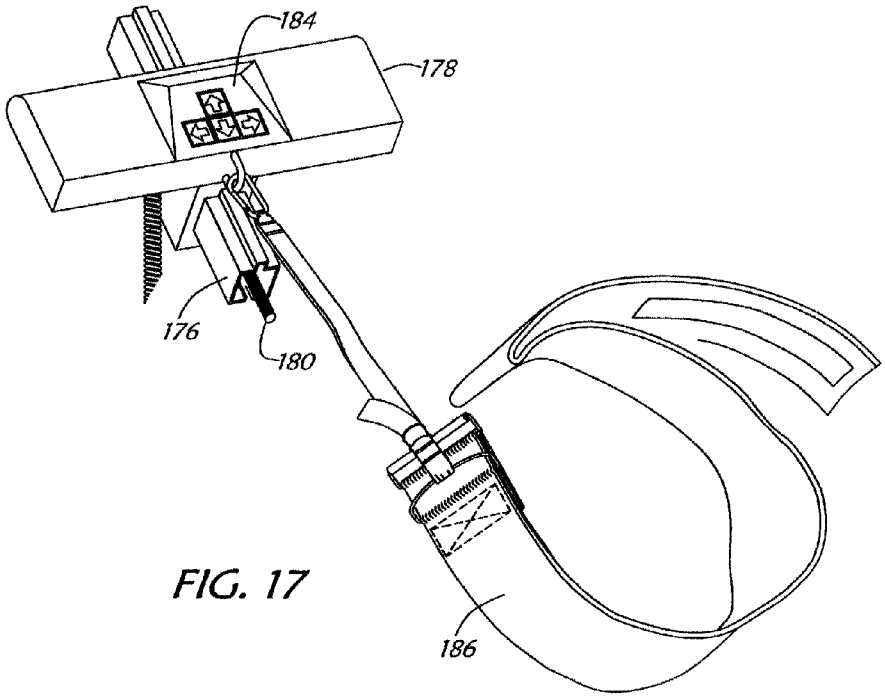
FIG. 17 is a perspective view of a lift bar of a second embodiment of a swivel lift grab bar in accordance with the present invention.

With reference to FIG. 9, a second embodiment of the swivel lift grab bar 2 includes an angled lift member 170 and a bottom leg 172. With reference to FIG. 17, the angled lift member 170 includes a lift channel 176, a lift bar 178, a lead screw 180 and a drive motor 182. The lead screw 180 is retained in the lift channel 176 and the lift bar 178 is threadably engaged with the lead screw 180. The lead screw 180 is rotated by the drive motor 182. With reference to FIG. 17, a set of controls 184 are located on the lift bar 178 to control a height of the lift bar 178 and the rotation of the swivel lift grab bar 2 through a pivoting drive motor 185. A torso belt 186 may be wrapped around a user 200 to lift the user 200 to a standing position. With reference to FIG. 16, the lift bar 178 may be replaced with a lift handle 179. With reference to FIG. 18, control of the drive motor 182 and pivoting drive motor 185 may be accomplished with a helper control device 181, operated by another person. The lift bar 178, the lift handle 179 and the helper control device 181 are shown as having a wired connection. However, lift bar 178, the lift handle 179 and the helper control device 181 could also have a wireless connection.

Figure 11A:
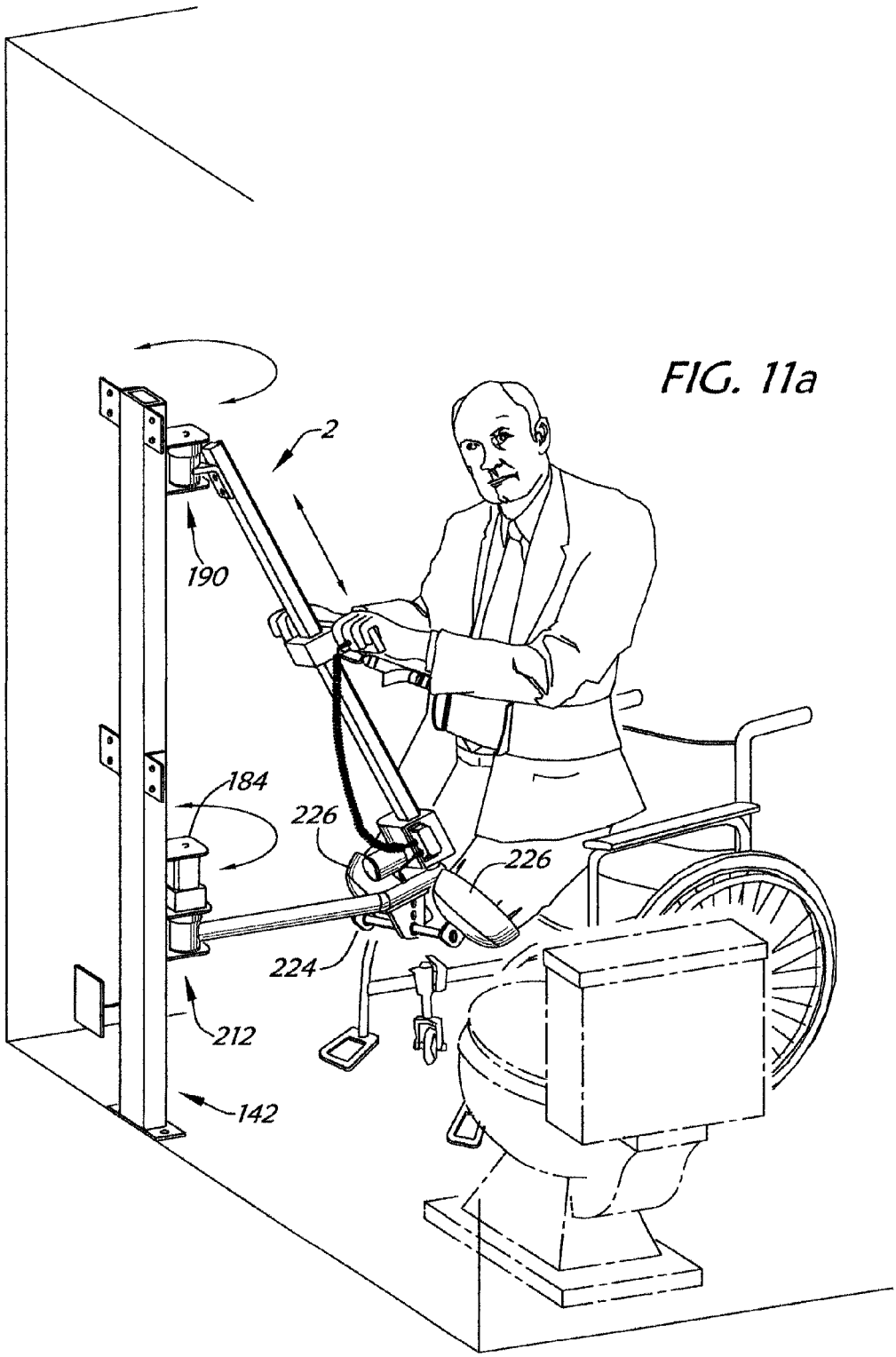
FIG. 11*a* is a perspective view of a second embodiment of a swivel lift grab bar pivotally retained on a wall mounted support post with a double leg cup in accordance with the present invention.

The double knee support 86 is preferably attached to a bottom of the bottom leg 172 at substantially the junction of the angled support pole 176. The double foot rest 120 may be pivotally mounted to the double knee support 86. With reference to FIG. 11*a*, the double knee support 86 and the double foot rest 188 may be replaced with a double leg cup 224. The double leg cup 224 includes two thigh cups 226 for the insertion of partially amputated leg thighs.

Figure 12:
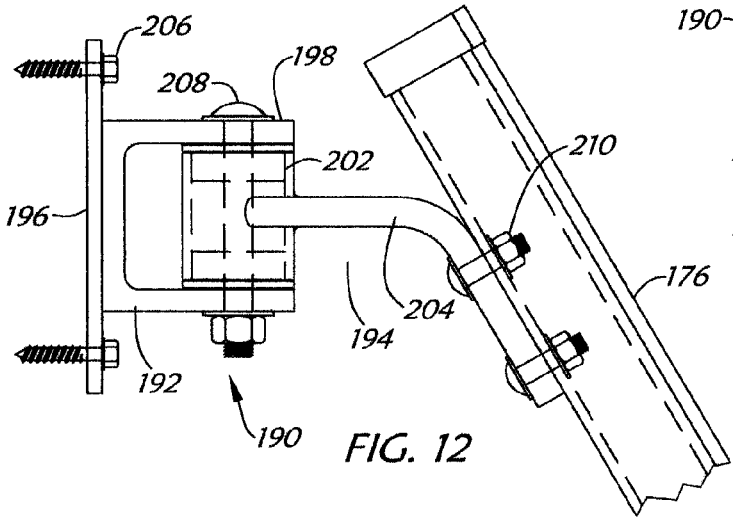
FIG. 12 is a side view of a top bracket, top leg and an angled lift member of a second embodiment of a swivel lift grab bar in accordance with the present invention.
Figure 12A:
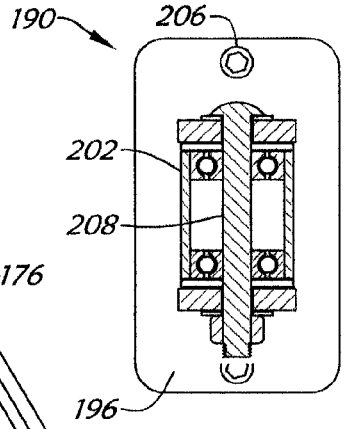
FIG. 12*a* is a cross sectional view of a top bracket and a top leg of a second embodiment of a swivel lift grab bar in accordance with the present invention.

With reference to FIGS. 12-12*a*, a top swivel assembly 190 includes a top bracket 192 and a top swivel arm 194. The top bracket 192 includes a top mounting plate 196 and a top yoke 198. The top mounting plate 196 is formed on a rear of the top yoke 198. The top swivel arm 194 includes a top swivel insert 202 and a top arm 204. The top arm 204 extends from the top swivel insert 202. The top arm 204 could also be characterized as the top leg of the swivel lift grab bar 2. The top bracket 192 is mounted to a wall with at least two fasteners 206. The top swivel insert 202 is pivotally retained in the top yoke 198 with a pivot fastener 208. The top arm 204 is attached to a top of the lift channel 176 with at least two fasteners 210.

Figure 13:
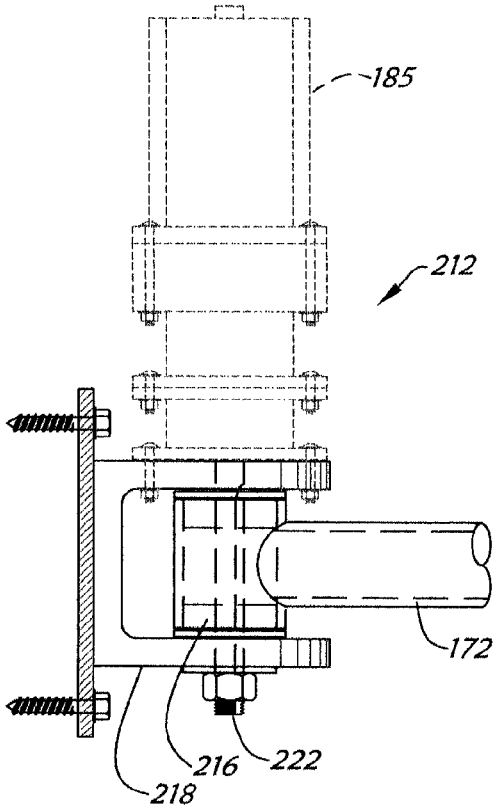
FIG. 13 is a side view of a bottom bracket, a bottom leg and a pivoting drive motor of a second embodiment of a swivel lift grab bar in accordance with the present invention.
Figure 13A:
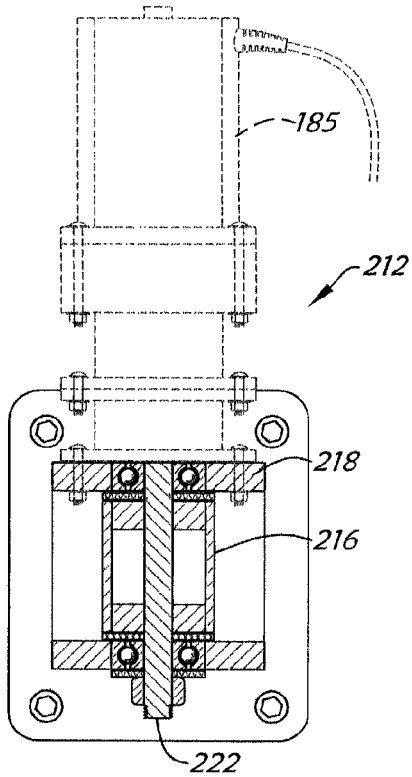
FIG. 13*a* is a cross sectional view of a bottom bracket and a bottom leg of a second embodiment of a swivel lift grab bar in accordance with the present invention.

With reference to FIGS. 13-13*a*, a bottom swivel assembly 212 includes a bottom bracket 214 and a bottom swivel insert 216. The bottom bracket 214 includes a bottom mounting plate 215 and a bottom yoke 218. The bottom mounting plate 215 is formed on a rear of the bottom yoke 218. The bottom swivel insert 216 is attached to an end of the bottom leg 172. The bottom bracket 214 is mounted to a wall with at least two fasteners 220. The bottom swivel insert 216 is pivotally retained in the bottom yoke 218 with a pivot fastener 222. The pivoting drive motor 185 may be used to pivot the swivel lift grab bar 2.

Figure 14:
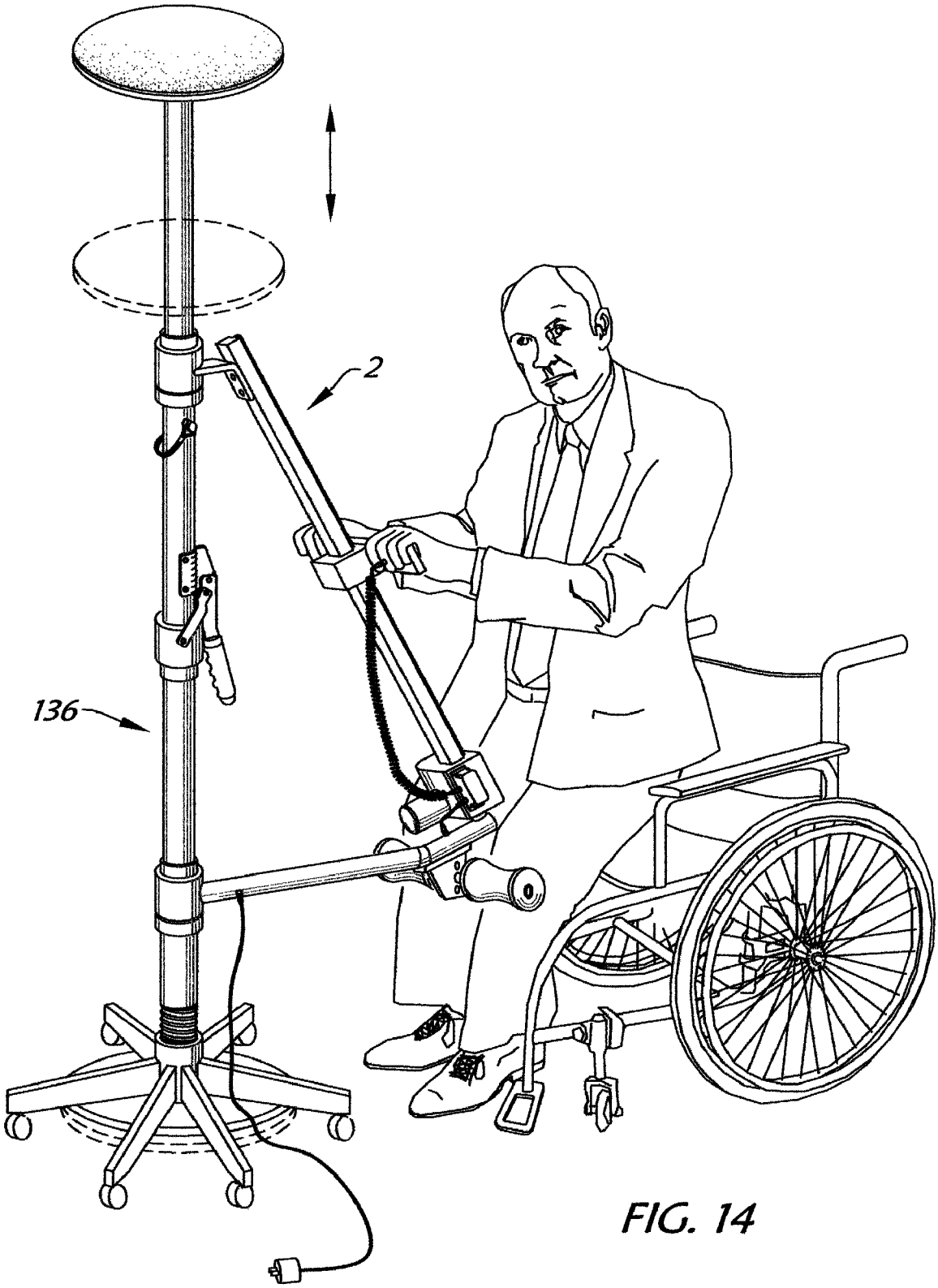
FIG. 14 is a perspective view of a second embodiment of a swivel lift grab bar pivotally retained on a moveable support pole in accordance with the present invention.
Figure 15:
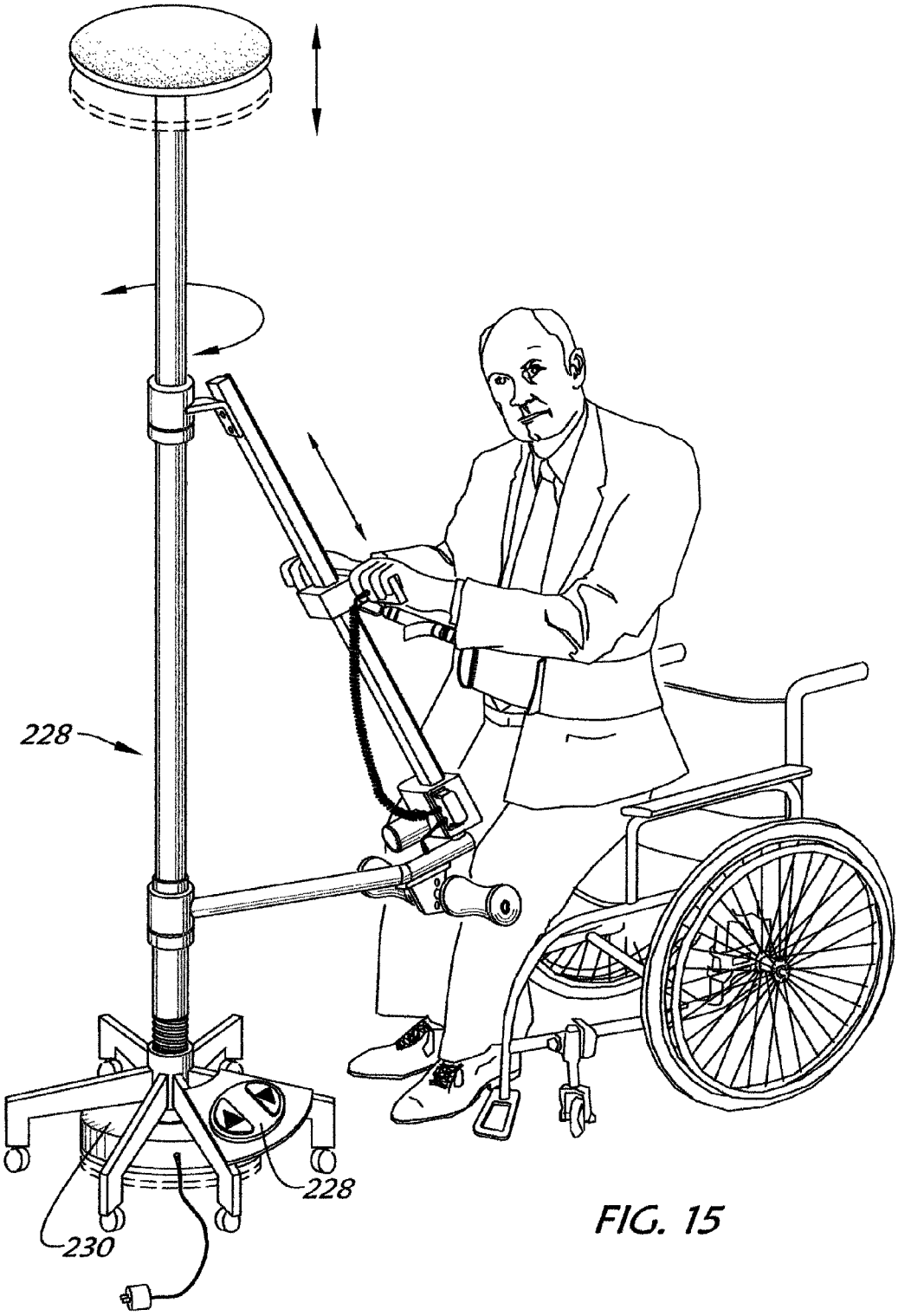
FIG. 15 is a perspective view of a second embodiment of a swivel lift grab bar pivotally retained on an automated moveable support pole in accordance with the present invention.

With reference to FIG. 14, the swivel lift grab bar 2 pivotally retained on the moveable support pole 136. With reference to FIG. 15, the moveable support pole 136 is modified by adding a swivel module 230 with a foot operated swivel control device 232 to form an automated moveable support pole 228.

With reference to FIGS. 19-19*b*, a bottom adjustable pivot assembly 234 includes a mounting bracket 236, a pivot pin 238, a pivot sleeve 240 and a rotation control assembly 242. The mounting bracket 236 includes a mounting plate 244 and a mounting projection 246. A plurality of mounting holes 248 are formed through the mounting plate 244. The pivot pin 238 includes a orientation flange 250. A plurality of orientation teeth 252 are formed on a bottom of the orientation flange 250. An indexing ring 254 includes a plurality of orientation teeth 256 formed on a top and a key projection 258 formed on a bottom thereof. A key slot 260 is formed on a top of the mounting projection 246 to receive the key projection 258.

A fastener 262 is used to retain the pivot pin 238 and the indexing ring 254 relative to the mounting projection 246. An external angle flat 264 is formed on an end of the pivot pin 238. An tab 266 extends from the orientation flange 250 to allow angular adjustment of the external angle flat 264. A sleeve bore 268 is formed in the pivot sleeve 240. An internal angle flat 270 is formed at a bottom of the sleeve bore 268 to receive the external angle flat 264.

The rotation control assembly 242 includes an adjustment shaft 272, a shaft retainer 274, a turn knob 276 and a friction pad 278. The turn knob 276 is attached to one end of the adjustment shaft 272 and an adjustment thread 280 is formed on the other end of the adjustment shaft 272. The shaft retainer 274 is attached to the bottom leg 12 with a plurality of fasteners 282. The adjustment shaft 272 is inserted through a hole in the shaft retainer 274. A threaded boss 284 is formed on a perimeter of the pivot sleeve 240. The threaded boss 284 includes a female thread that is sized to threadably receive the adjustment thread 280. A pad cavity 286 is formed in the pivot sleeve 240 to receive the friction pad 278. The friction pad 278 is rotatably retained on the other end of the adjustment shaft 272 with a fastener 288. Preferably, clockwise rotation of the turn knob 276 forces the friction pad 278 against the pivot pin 238 to restrict the free swinging movement of the angled support member 10.

However, the pivot pin 238 and the pivot sleeve 240 may be fabricated without the external and internal angle flats and without the need for the indexing ring 254. The pivot pin 238 would be rigidly attached to the mounting projection 246, similar to FIG. 4. Rotation of the turn knob 276 restricts the free swinging movement of the angled support member 10.

Figure 20:
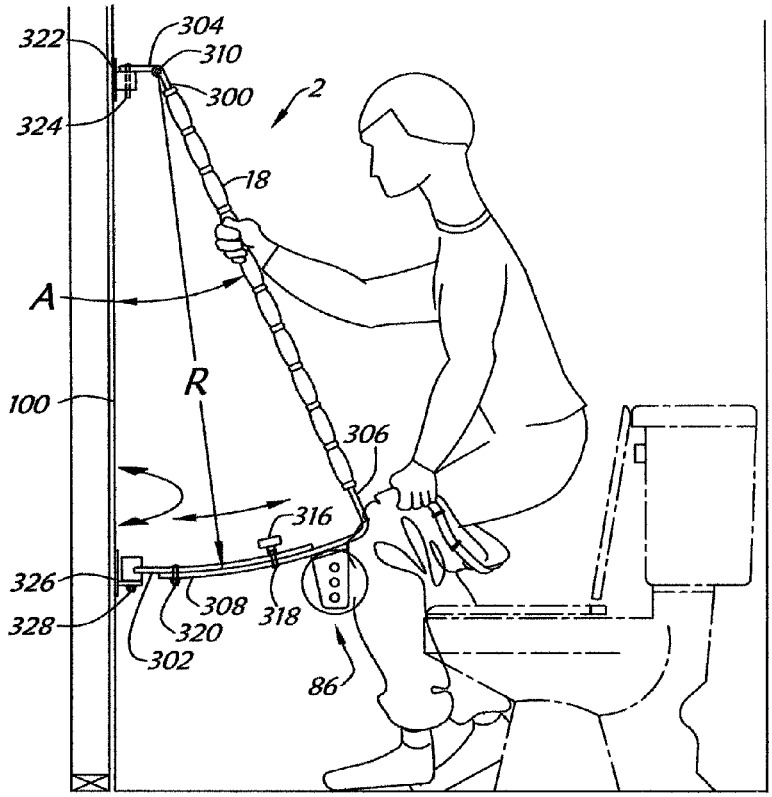
FIG. 20 is a side view of an adjustable swivel lift grab bar in accordance with the present invention.
Figure 20A:
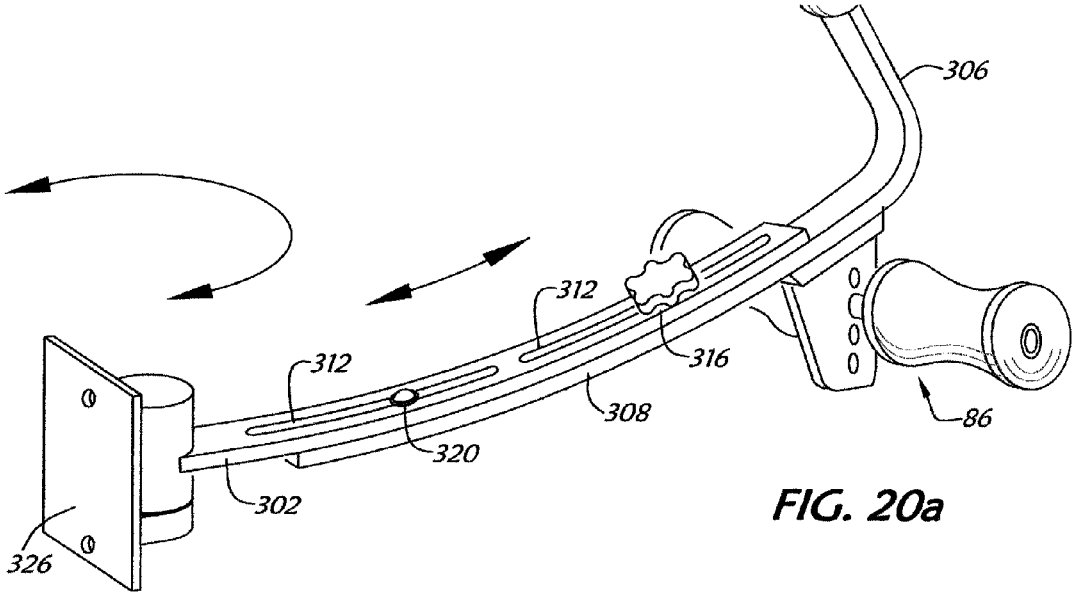
FIG. 20*a* is an enlarged perspective view of a bottom leg of an adjustable swivel lift grab bar in accordance with the present invention.

With reference to FIGS. 20-20*a*, a second embodiment of an adjustable swivel lift grab bar 2 includes an angled support member 300, a bottom leg 302 and a top leg 304. The angled support member 300 includes an angled portion 306 and a bottom portion 308. A grab cover 18 may be slipped over the angled portion 306 or the angled portion 306 may be tubular with a knurled finish as shown in FIGS. 2-2*b*. One end of the top leg 304 is pivotally engaged with a top of the angled portion 306 with a pivot pin 310 or the like. The bottom portion 308 extends from a bottom of the angled portion 306. The bottom portion 308 includes a curved length. The curved length of the bottom portion 308 is preferably defined by a radius "R" with an origin at a center line of the pivot pin 310. At least two slots (not shown) are formed through the bottom portion 308.

The bottom leg 302 includes a curved length defined by the radius "R." At least two slots 312 are formed through the bottom leg 302. A turn knob 316 is threadably engaged with a bolt 318 to retain a particular angle "A" of the angled portion 306 relative to a vertical surface 100. A slide pin 320 aligns and allows slidable motion between the bottom leg 302 with the bottom portion 308. The other end of the top leg 304 is pivotally engaged with a top bracket 322 using a fastener 324 or the like. The top bracket 322 is attached to the vertical surface 100. The bottom leg 302 is pivotally engaged with a bottom bracket 326 using a fastener 328 or the like. The double knee support 86 is preferably attached to a bottom of the bottom portion 308. The adjustable swivel lift grab bar 2 may also incorporate a bottom adjustable pivot assembly 234 similar to that illustrated in FIGS. 19-19*b*.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A swivel lift grab bar comprising:

an angled support member includes a lift device and a linear actuator, said linear actuator moves said lift device along a length of said angled support member;

one end of a bottom leg extending from one end of said angled support member;

a bottom pivot bracket being attached to a vertical surface, the other end of said bottom leg being pivotally retained by said bottom pivot bracket; and a top pivot bracket being attached to the vertical surface, the other end of said angled support member is pivotally retained by said top pivot bracket, wherein said swivel lift grab bar pivoting at said top and bottom pivot brackets to transfer a user from a first position to a second position.

2. The swivel lift grab bar of claim 1, further comprising:

means for restricting free swinging movement of said angled support member.

3. The swivel lift grab bar of claim 1, further comprising:

a motor being engaged with one of said top and bottom pivot brackets, said motor pivoting said swivel lift grab bar relative to the vertical surface.

4. The swivel lift grab bar of claim 1, further comprising:

said top and bottom pivot brackets being attached to a wall mounted support post.

5. The swivel lift grab bar of claim 1, further comprising:

means for supporting a pair of knees retained near a junction of said bottom leg and said angled support member.

6. The swivel lift grab bar of claim 5, further comprising:

a double knee support being retained near a junction of said bottom leg and said angled support member.

7. A swivel lift grab bar comprising:

an angled support member includes a lift device and a linear actuator, said linear actuator moves said lift device along a length of said angled support member;

one end of a bottom leg extending from one end of said angled support member;

a bottom pivot bracket being pivotally retained on a vertical surface, the other end of said bottom leg being attached to said bottom pivot bracket; and a top pivot bracket being attached to the vertical surface, the other end of said angled support member is pivotally retained by said top pivot bracket, wherein a torso belt is secured to said lifting device and around a torso of a user, the user being lifted from a sitting position into an upright position.

8. The swivel lift grab bar of claim 7, further comprising:

a motor being engaged with one of said top and bottom pivot brackets, said motor pivoting said swivel lift grab bar relative to the pole.

9. The swivel lift grab bar of claim 7, further comprising:

said vertical surface being a moveable support pole, said moveable support pole including a telescoping tube, said moveable support pole being retained between a ceiling and a floor.

10. A swivel lift grab bar comprising:

an angled support member includes a lift device and a linear actuator, said linear actuator moves said lift device along a length of said angled support member;

one end of a bottom leg extending from one end of said angled support member;

a bottom pivot bracket being pivotally retained on a vertical surface, the other end of said bottom leg being attached to said bottom pivot bracket; and a top pivot bracket being attached to the vertical surface, the other end of said angled support member is pivotally retained by said top pivot bracket, wherein a torso belt is secured to said lifting device and around a torso of a user, the user being lifted from a sitting position into an upright position, said swivel lift grab bar pivoting at said top and bottom pivot brackets to transfer the user from a first position to a second position.

11. The swivel lift grab bar of claim 10, further comprising:

a motor being engaged with one of said top and bottom pivot brackets, said motor pivoting said swivel lift grab bar relative to the vertical surface.

12. The swivel lift grab bar of claim 10, further comprising:

said vertical surface being a moveable support pole, said moveable support pole including a telescoping tube, said moveable support pole being retained between a ceiling and a floor.

* * * * *